United States Patent [19]

Rostron

[11] 3,987,262

[45] Oct. 19, 1976

[54] PUFFER-TYPE GAS-BLAST CIRCUIT-INTERRUPTER HAVING VARIABLE-AREA STATIONARY COMPOSITE PISTON STRUCTURE

[75] Inventor: Joseph R. Rostron, Monroeville, Pa.

[73] Assignee: Westinghouse Electric Corporation, Pittsburgh, Pa.

[22] Filed: May 12, 1975

[21] Appl. No.: 576,820

[52] U.S. Cl. ..... 200/148 A; 200/144 AP; 200/82 B

[51] Int. Cl.[2] ..... H01H 35/38

[58] Field of Search..... 200/144 AP, 148 R, 148 A, 200/148 B, 82 R, 82 B, 323, 324, 325

[56] References Cited

UNITED STATES PATENTS

| | | | |
|---|---|---|---|
| 3,538,282 | 11/1970 | Leeds | 200/148 B |
| 3,551,623 | 12/1970 | Colclaser, Jr. | 200/148 A |
| 3,769,479 | 10/1973 | Leeds | 200/148 A |

*Primary Examiner*—Gerald P. Tolin
*Attorney, Agent, or Firm*—W. R. Crout

[57] ABSTRACT

A puffer-type gas-blast circuit-interrupter is provided having an operating cylinder movable over a fixed composite piston structure, the fixed composite piston structure providing a variable cross-sectional area by means of a secondary piston area, preferably annular in configuration, which is releasably latched in a fixed forward position, and, subsequently, during the opening operation of the breaker, collapsed to a retracted position.

The composite piston arrangement may be such that upon collapse of the secondary "fixed" piston, the diameter of the surrounding movable operating cylinder may be such as to closely surround the central area of the primary fixed piston structure to retain high-pressure gas within the piston-compression chamber without loss.

There results, by the utilization of the variable-area fixed composite piston structure, an improved interrupting performance of the circuit-interrupter by giving very high gas pressures early in the opening stroke of the circuit-interrupter, as compared to prior-art conventional structures, which provide such high gas pressure only at a later time in the opening stroke by conventional piston means.

9 Claims, 8 Drawing Figures

L1
4
3
CLOSED POSITION
6
7
1
37
22
20
D
35
2
"P"
37
36

"L"
28
9
9
26
30
24
"L"
24a
40
34
43
19
34
32
32
41
L2
10
18
17
16
14
13
12

PARTIALLY OPEN-CIRCUIT POSITION

PUFFER-TYPE GAS-BLAST CIRCUIT-INTERRUPTER HAVING VARIABLE-AREA STATIONARY COMPOSITE PISTON STRUCTURE

CROSS-REFERENCES TO RELATED APPLICATIONS

Applicant is not aware of any related patent applications pertinent to the present invention.

BACKGROUND OF THE INVENTION

The present invention is particularly related to puffer-type circuit-interrupters of the type in which only a single pressure is utilized within the interrupting structure, and a difference of pressure for arc interruption is achieved by piston action, that is, relative movement of an operating cylinder to a piston structure. As well known by those skilled in the art, the relative motion between the operating cylinder and the piston achieves a desirable compression of gas within the compression chamber, which gas is utilized during arc interruption by generally forcing the high-pressure gas through a hollow nozzle structure to direct the high pressure gas flow intimately into engagement with the established arc to effect the latter's extinction.

DESCRIPTION OF THE PRIOR ART

The present invention relates to puffer-type circuit interrupters of the type set forth in U.S. Pat. No. 3,551,623, issued Dec. 29, 1970, to Robert G. Colclaser, Jr. and William H. Fischer. This patent shows the relative motion of a movable piston within a relatively-stationary operating cylinder, with electromagnetic coils energizing a companion movable piston, which is electrically repelled toward the first-mentioned movable piston, the latter being attached to, and movable with, a contact-operating rod.

As well known by those skilled in the art, there are many patents treating different piston structures, for example, U.S. Pat. No. 2,429,311, issued Oct. 21, 1947, to M. J. Gay and U.S. Pat. No. 3,786,215, issued Jan. 15, 1974 to Gerhard Mauphe.

An additional patent of interest in connection with piston structures is U.S. Pat. No. 3,331,935, issued July 18, 1967 to Stanislaw A. Milianowicz. Another piston patent, utilizing hydraulic action for effecting piston action, is U.S. Pat. No. 2,913,559, issued Nov. 17, 1959, to Charles F. Cromer.

An additional patent of interest is German Pat. No. 671,326 patented in Germany October 1937. All of the aforesaid patents indicate that piston structures of the prior art are well known, but many have deficiencies of complexity and of being rather slow in operation. In addition, back-pressure gas conditions may easily arise, which renders the interrupter, as a whole, relatively slow-acting in operation generally taking perhaps 8 cycles to effect circuit interruption.

BRIEF SUMMARY OF THE INVENTION

An improved puffer-type gas-blast circuit-interrupter is provided having a relatively stationary contact structure cooperable with a movable contact structure, the latter being affixed to, and movable with, a movable operating cylinder. The movable operating cylinder moves over a relatively fixed composite piston structure, the fixed composite piston structure comprising a central stationary fixed primary-piston portion, and, preferably, a surrounding annularly shaped secondary piston structure thereabout.

The secondary annular piston structure is releasably latched in a forward operative position, in which position it complements and augments the relatively fixed primary piston portion at the beginning of the opening stroke, or opening operation of the circuit-interrupter.

A suitable latched toggle structure may be provided, for example, as a means of initially maintaining the secondary surrounding annular fixed piston structure in a forward extended position to obtain, thereby, high-gas pressures very early in the opening piston stroke, or opening operation of the circuit-interrupter.

At a subsequent period of time, during the opening operation of the circuit-interrupter, means are provided to releasably break the straightened toggle structure and, thereby, to effect a collapse of the surrounding secondary fixed piston to a retracted position to thereby immediately decrease the total area of the entire fixed composite piston structure.

Preferably, the piston construction may be such that upon unlatching of the secondary fixed piston structure, and thereby permitting its retracting movement, a sleeve portion, for example, of the movable operating cylinder is such in diameter as to closely surround the interiorly-arranged remaining primary fixed piston structure to thereby maintain the existence of high-gas pressure conditions within the gas-compression chamber of the puffer-cylinder, or "bottle."

DESCRIPTION OF THE PREFERRED EMBODIMENTS

Figure 1:
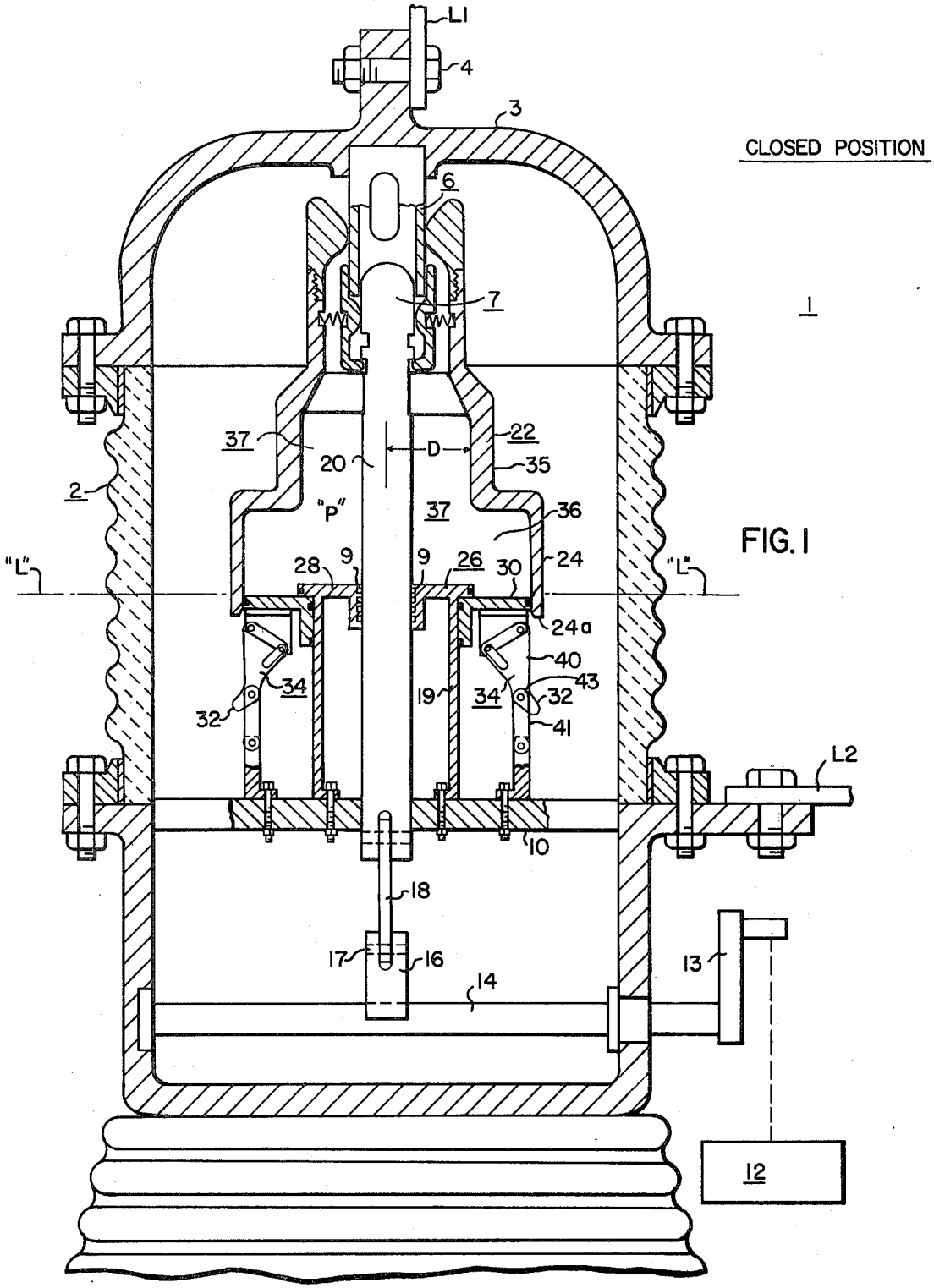
FIG. 1 is a vertical sectional view taken through one embodiment of the present invention illustrating a gas-blast puffer-type circuit-interrupter with the separable contacts illustrated in the closed-circuit position.
Figure 2:
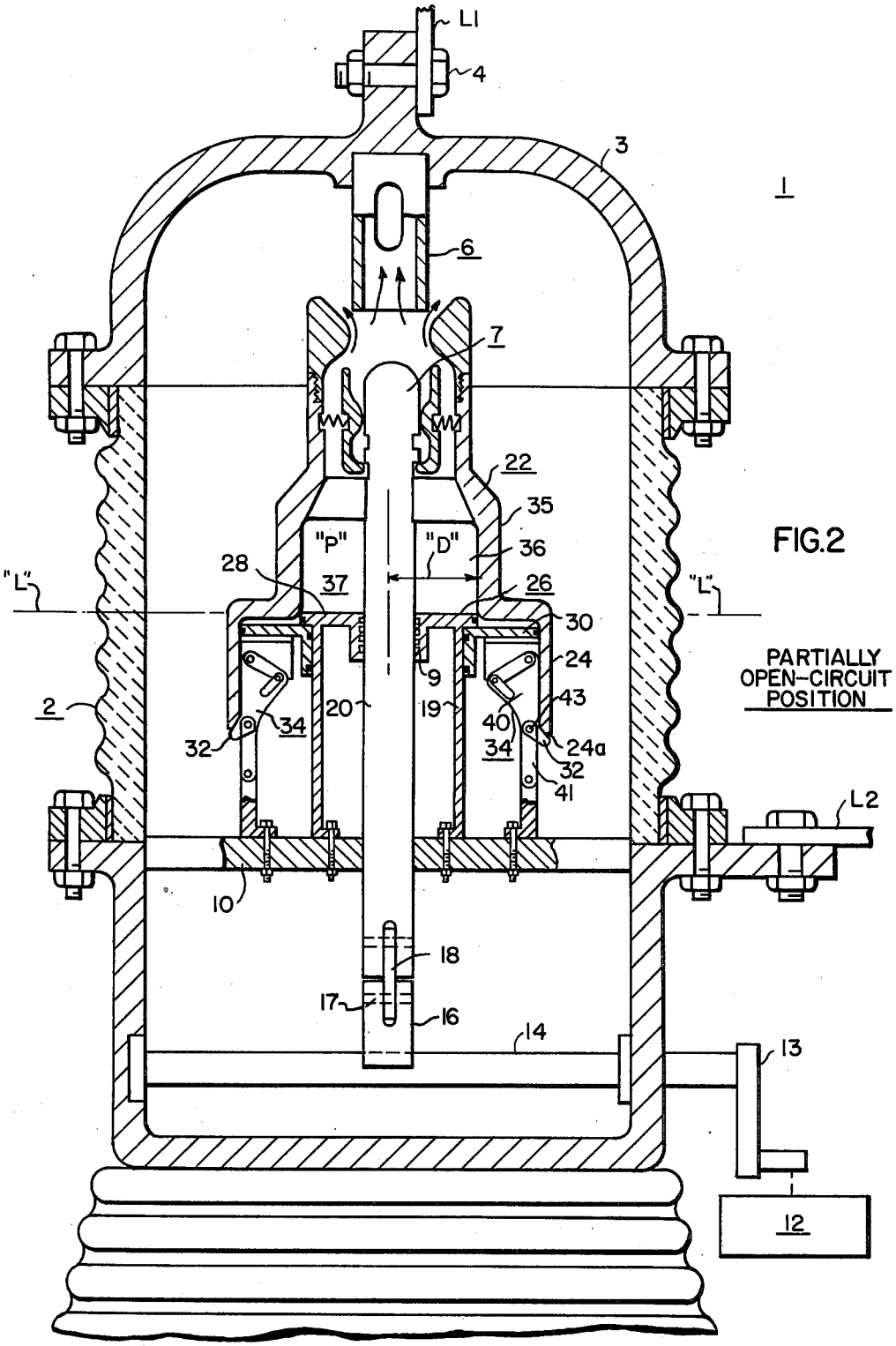
FIG. 2 is a view similar to FIG. 1, but illustrating the disposition of the several composite piston parts in the partially-open-circuit position of the circuit-interrupter, with the secondary piston structure shown in its extended position.
Figure 4:
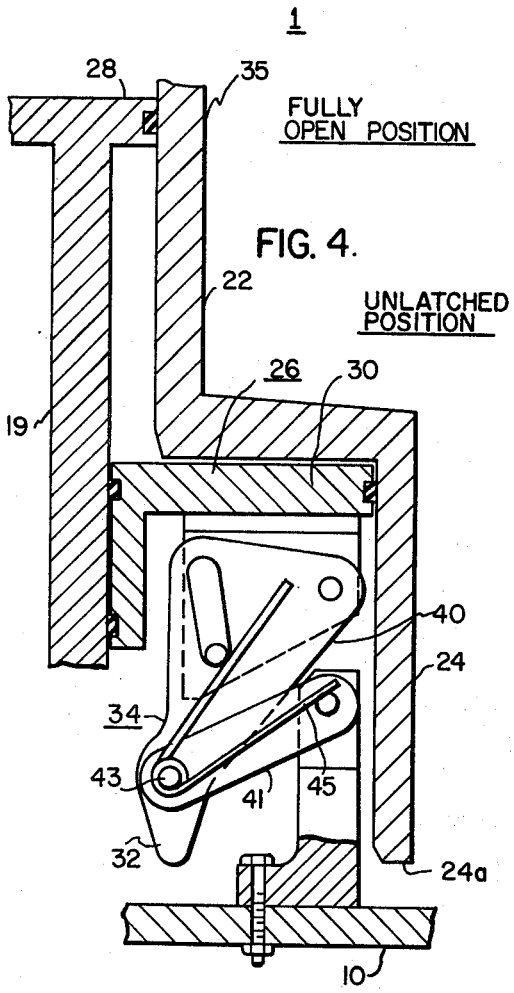
FIG. 4 is an enlarged fragmentary view of a portion of the piston structure of FIG. 2 showing, in more detail, the collapsible toggle-linkage and the collapsed condition of the secondary fixed piston in the fully open-circuit position of the interrupter.
Figure 3:
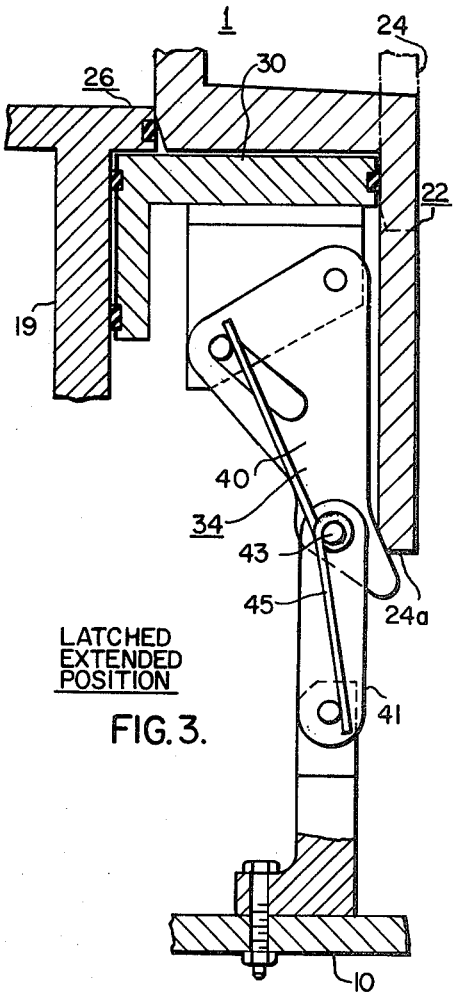
FIG. 3 illustrates a view of the toggle-linkage supporting the secondary fixed piston structure of FIG. 2 at a time at which releasing action of the toggle-linkage is about to ensue.
Figure 5:
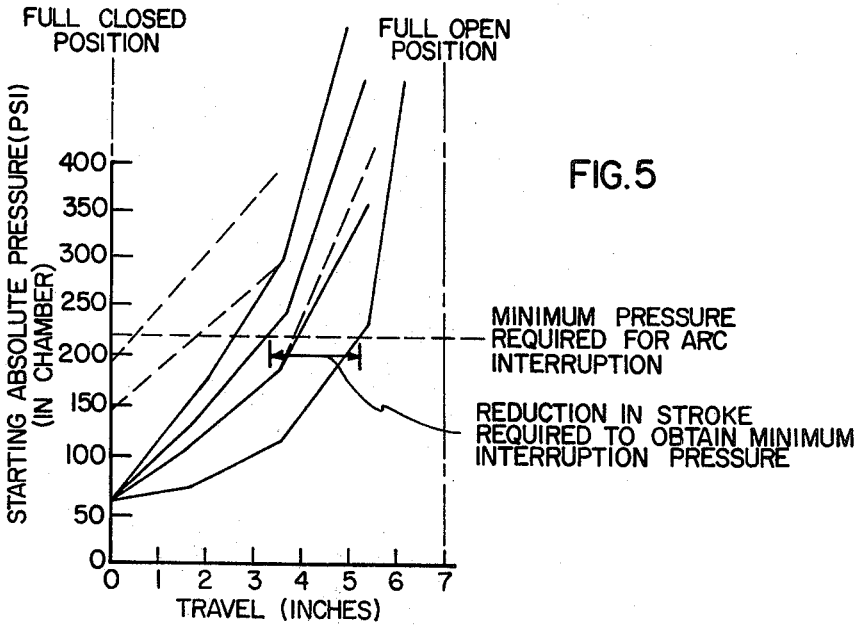
FIG. 5 is a graph of the absolute pressure within the piston-compression chamber as a function of opening travel distance of the movable operating cylinder, indicating the minimum pressure required for arc interruption, and also illustrating the reduction in piston stroke required to obtain minimum arc-interruption pressure.

Referring to the drawings, and more particularly to FIGS. 1–4 thereof, it will be observed that there is provided a puffer-type circuit-interrupter 1 having an upstanding casing structure 2, which is provided at its upper end with a conducting dome-shaped conducting cap portion 3, the latter supporting, through a bolt 4, a line-terminal connection $L_1$. Extending downwardly interiorly of the conducting dome-shaped casting 3 is a relatively stationary contact structure, designated by the reference numeral 6, and cooperable with a movable contact structure 7, as illustrated more clearly in FIG. 2 of the drawings. The movable contact structure 7 is electrically connected, by a plurality of sliding ring contacts 9, to a generally horizontally extending conducting plate 10, which provides a second line terminal $L_2$, as shown more clearly in FIG. 1.

A suitable operating mechanism 12 effects rotation of an externally provided crank-arm 13, the latter effecting opening and closing rotative travel of an internally disposed operating shaft 14. The operating shaft 14, in turn, is connected to an internally disposed crank-arm 16, which is pivotally connected, as at 17, to a floating link 18, the latter being mechanically connected to the lower end of a linearly movable operating rod 20.

It will be noted that the upper end of the operating rod 20 forms the movable contact 7, which, as mentioned heretofore, makes contacting closed-circuit engagement with the stationary contact structure 6 in the closed-circuit position of the device 1, as illustrated in FIG. 1.

A movable operating cylinder 22 is provided having a larger-diameter, downwardly extending sleeve portion 24, which slidably moves over the relatively fixed composite piston structure 26, as illustrated in FIG. 1. It will be observed that the relatively fixed composite piston structure 26, in fact, comprises a central fixed "primary" piston portion 28 and a surrounding annularly disposed "secondary" piston portion 30, which is releasably latched in its extended forward position, as illustrated in FIG. 1.

During the opening operation, at a predetermined time, a lower skirt portion 24a of the movable operating cylinder 24 engages a dog 32, which effects collapse of the toggle-linkage 34, and thereby permits retracting downward motion of the secondary piston structure 30. At the time of collapse of the toggle structure 34, it will be observed that the diameter D of a portion 35 of the movable operating cylinder 22 is such as to closely encompass the central fixed primary piston portion 28, so that high-pressure gas 36 is maintained within the piston compression region 37.

Preferably, the toggle-linkage 34 comprises a pair of pivotally interconnecting toggle-links 40 and 41, the knee-pin 43 of which has a helical spring 45 surrounding the knee-pin 43 to provide a biasing action tending to effect straightening of the toggle-linkage 34, as illustrated in FIG. 1.

During the closing operation, the movable operating cylinder 22, as viewed in FIG. 1, moves upwardly thereby enabling the relatching of the secondary fixed piston portion 30, so that in the fully closed-circuit position of the device 1 as shown in FIG. 1, the secondary fixed piston portion 30 is on a substantial coincident level L with the centrally disposed relatively fixed primary piston portion 28, as illustrated in FIG. 1.

The piston construction 26 of the present invention has the desirable advantage that relatively high gas pressures are obtained early in the opening piston stroke, as compared to late in the opening piston stroke, as provided by prior-art conventional piston structures of the type set forth in the U.S. patents referred to above.

Inasmuch as there is plenty of piston-stroke left, with high gas pressure P on top of the stationary "primary" piston structure 28, the arcing range is considerably lengthened. The advantage, as mentioned hereinbefore, results that high gas pressures give an early arc extinction and a fast-acting two-cycle puffer-type circuit-interrupter 1.

Figure 6:
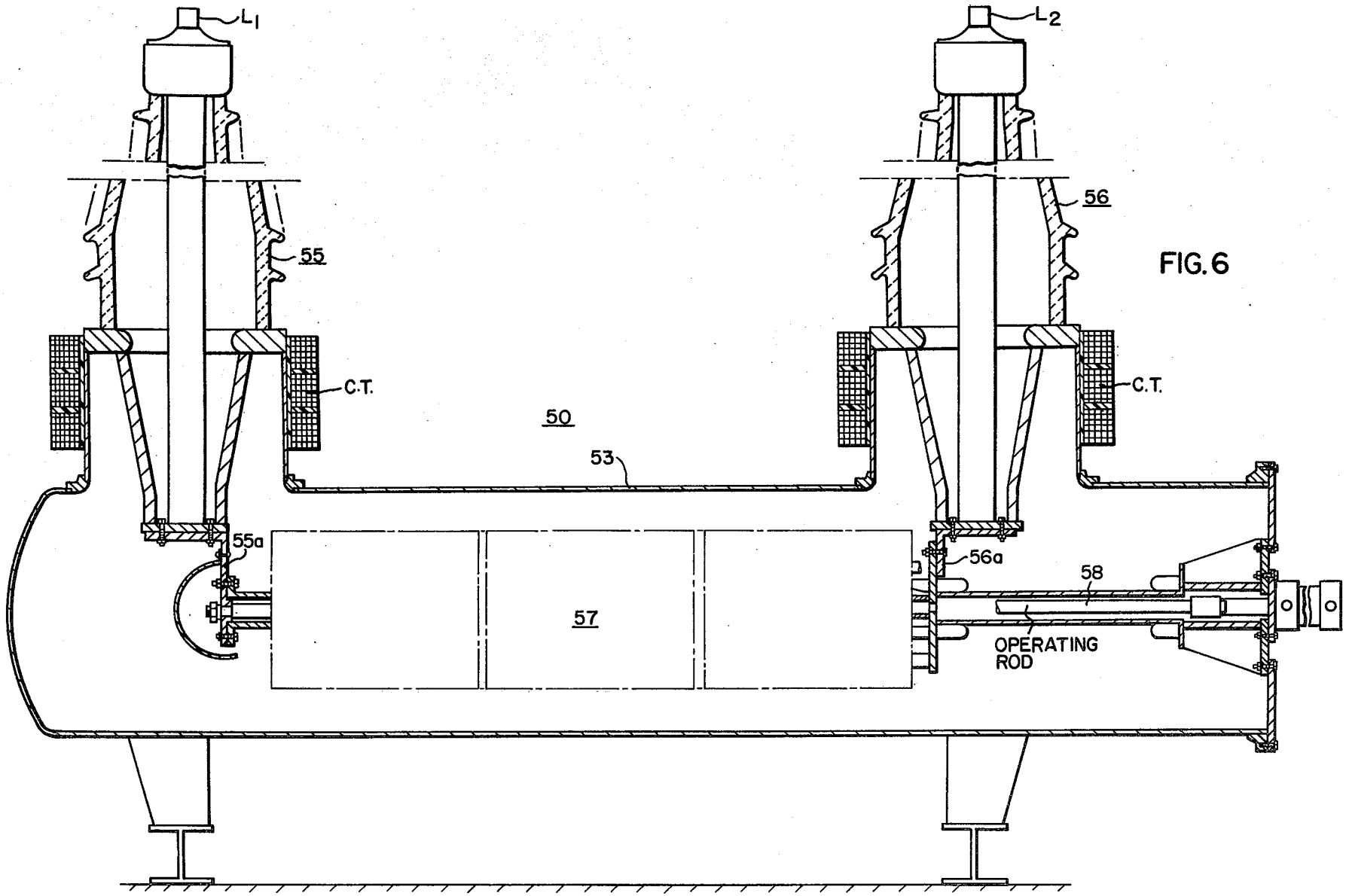
FIG. 6 is a side-elevational view of a further embodiment of the present invention, as applied to a high-power multi-break circuit-interrupter, utilizing closing resistances for preventing closing-voltage surges occurring on the connected transmission line during the closing operation of the circuit-interrupter.
Figure 7:
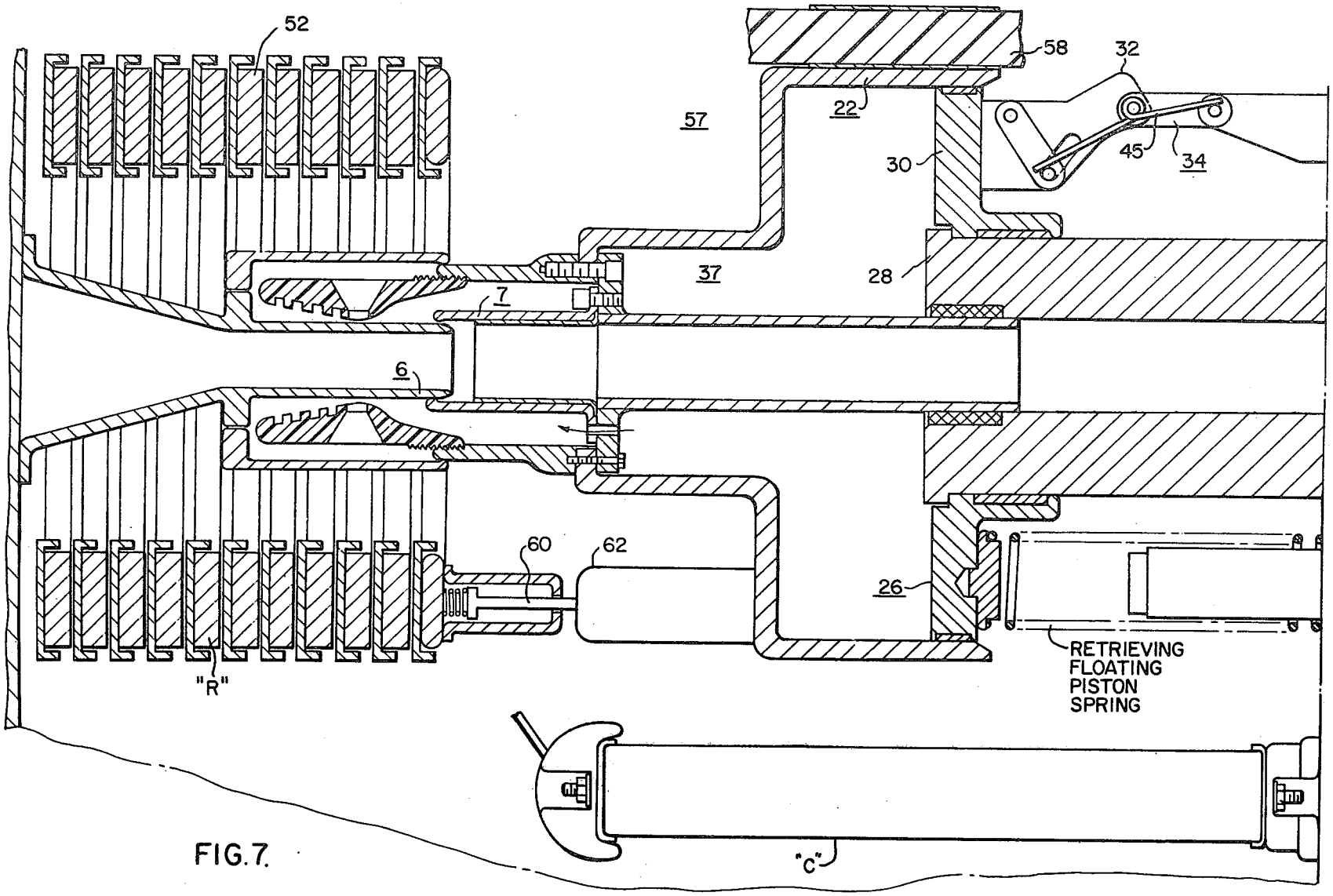
FIG. 7 illustrates a considerably-enlarged view of one of the contact breaks of the multi-break circuit-interrupter of FIG. 6, illustrating the contact structure in the closed-circuit position; and, FIG. 8 is a view somewhat similar to that of FIG. 7, but illustrating the disposition of the several parts in the fully-closed-circuit position of the device.
Figure 8:
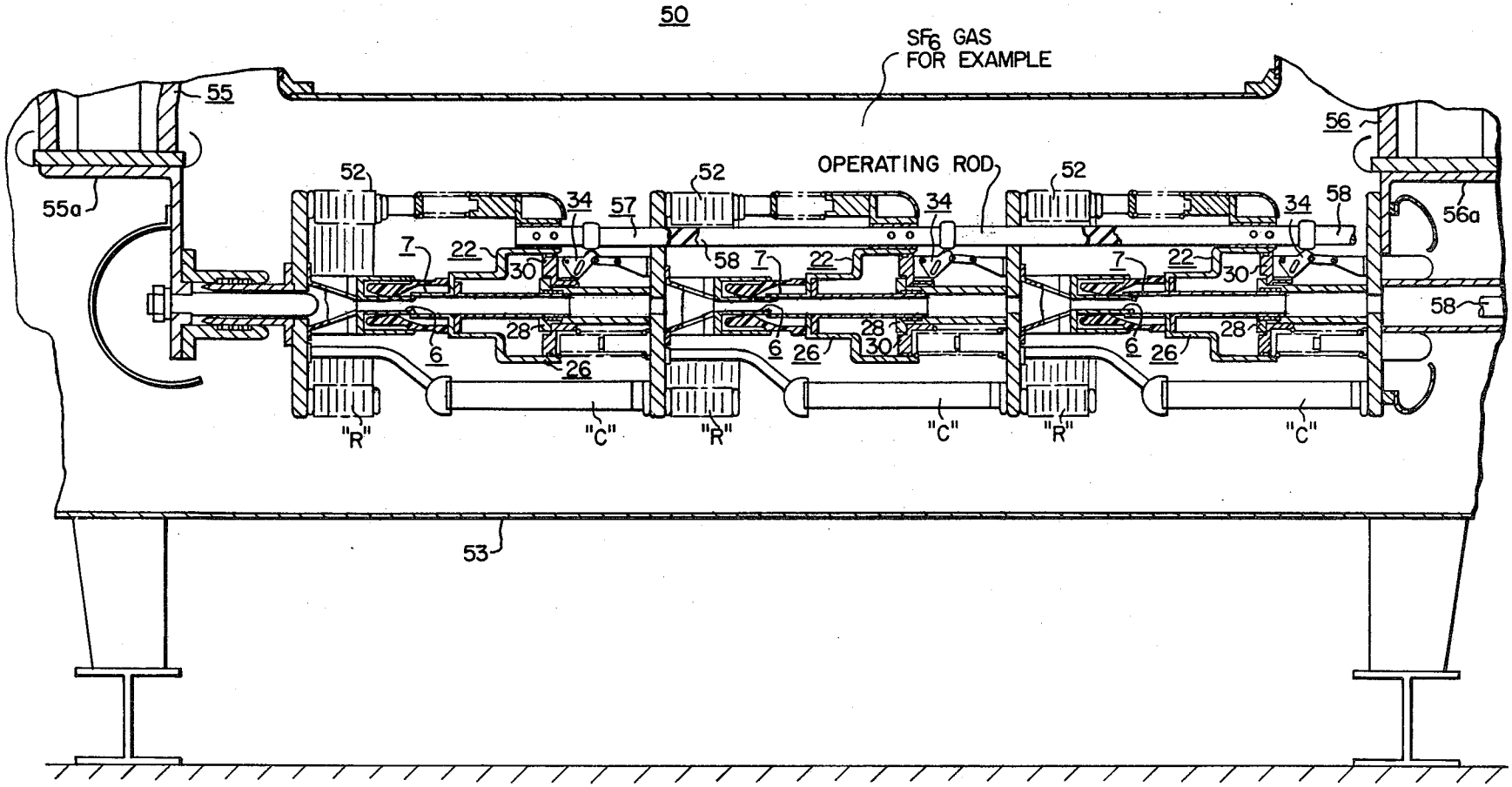

FIG. 6 illustrates an alternate form of the invention 50, as applied to a high-power circuit-interrupter of the type which may be accommodated with closing resistances 52, as more clearly illustrated in FIGS. 7 and 8 of the drawings. With reference to FIG. 6, it will be observed that there is provided a generally longitudinally-extending metallic grounded tank structure 53, into the interior of which downwardly extends a pair of spaced terminal-bushings 55 and 56. An arc-extinguishing assemblage 57, as more clearly illustrated in FIG. 7 is supported at the lower interior spaced ends 55*a*, 56*a* of the terminal-bushings 55 and 56.

FIGS. 7 and 8 illustrate more clearly the break arrangement of the horizontally extending arc-extinguishing assemblage 57. With reference to FIG. 7, which shows the closed-circuit position of the device 50, it will be observed that again the fixed composite piston structure 26 comprises a central portion 28, and a surrounding annularly-shaped collapsible secondary piston portion 30, which may be, as described hereinbefore, latched in an extending forward position by the suitable toggle structure 34. The collapse of the toggle structure 34 is the same as provided heretofore.

As is well known by those skilled in the art, closing resistances 52 may be provided to minimize the existence of voltage surges on the connected transmission line during the closing operation. As viewed in FIGS. 7 and 8, a closing resistance 52 may be provided having the resistance values, as set forth in U.S. Pat. No. 3,291,947 issued Dec. 13, 1966 to Roswell C. VanSickle. An operating rod 58 may be connected to all of the piston structures 26 to cause their simultaneous opening and closing operations.

The resistance 52 may be connected to an outwardly biased resistance contact 60, which makes engagement during the closing operation, with a conducting protuberance or movable resistance contact 62 to thereby effect an insertion of the closing resistance 52 into the connected circuit $L_1$, $L_2$ during the closing operation prior to the actual engagement of the main contacts 6 and 7. Again reference may be made to the VanSickle U.S. Pat. No. 3,291,947, as cited heretofore.

FIG. 8 illustrates the fully closed-circuit position of the modified-type circuit-interrupter 50 of FIG. 6 with the secondary fixed piston structure 30 extended, and the contacts 6, 7 in the fully open-circuit position. Capacitances C may be provided to divide the voltage among the several breaks.

From the foregoing description of two embodiments of the invention, it will be apparent that there has been provided an improved puffer-type gas-blast circuit-interrupter 1, 50 having a movable operating cylinder 22, movable over a fixed piston structure 26, the latter comprising two piston portions 28, 30. One piston portion 28, herein termed the "primary" piston portion, is fixed at all times. A "secondary" collapsible piston portion 30 is provided, which is taken out of the compression stroke upon collapse of a toggle-linkage 34 operatively connected to it. It will be observed that at this time, namely the time of collapse of the secondary piston portion 30, that the surrounding movable operating cylinder 22 is so configured as to maintain the pressure within the piston-compression chamber 37.

Although there have been illustrated and described specific structures, it is to be clearly understood that the same were merely for the purpose of illustration, and that changes and modifications can readily be made therein by those skilled in the art without departing from the spirit and scope of the invention.

I claim:

1. A puffer-type compressed-gas circuit-interrupter including means defining a relatively stationary contact structure, means defining a cooperable movable contact structure, operating means including a movable operating piston-cylinder carrying said movable contact structure and slidable over a composite piston structure, said composite piston structure being within said operating cylinder and comprising a centrally-disposed primary relatively fixed piston and a surrounding annularly-shaped secondary movable piston structure, means releasably latching said secondary annular movable piston structure in a forward position towards the stationary contact structure during the initial portion of the opening operation of the circuit-interrupter, means effecting a collapse and a retracting movement of said secondary annular movable piston structure at an intermediate point during the opening operation of the circuit-interrupter, whereby the cross-sectional area of the composite piston structure is variable to thereby bring about a fast attainment of high-pressure gas in a piston compression chamber on one side of the composite piston structure during the initial portion of the opening stroke.

2. The combination according to claim 1, wherein a portion of the movable operating piston-cylinder has a diameter of substantially the same diameter as the relatively fixed primary piston portion, so that upon collapse of the secondary movable piston portion the high-pressure gas will be "trapped" within the piston compression chamber by the close engagement of said cylindrical portion with the primary fixed piston structure.

3. The combination according to claim 1, wherein a toggle structure is utilized to effect a releasably latched condition of the secondary annular movable piston structure.

4. The combination according to claim 3, wherein a skirt portion of the movable operating cylinder makes engagement with the toggle-linkage to effect the collapse thereof during an intermediate portion of the opening operation.

5. The combination according to claim 4, wherein a biasing spring encircles the knee-pin of the toggle-linkage to bias the toggle-linkage into a straightened condition.

6. The combination according to claim 1, wherein a closing resistance is provided, a relatively fixed closing resistance contact is connected to said closing resistance, a movable closing resistance contact is attached to and movable with the operating cylinder, and the construction is such that during the closing operation the cooperable closing resistance contacts make contacting engagement prior to a subsequent closing engagement of the main contacts to insert the resistance into the connected circuit.

7. The combination according to claim 6, wherein the relatively fixed closing resistance contact includes a movable contact biased by a spring to a forward engagement in the direction of the cooperable movable closing resistance contact.

8. A compressed-gas type of circuit-interrupter including means defining a composite piston structure including a fixed primary portion and a movable secondary portion, a movable operating piston cylinder containig said composite piston structure and having two effective diameter portions, said operating piston cylinder carrying a movable contact and a movable insulating orifice slidable over said composite piston structure, means defining a relatively stationary contact, means releasably latching the secondary portion of the composite piston structure in a forward position in a direction toward the stationary contact, means effecting a reduction of the cross-sectional area of the composite piston structure during an intermediate portion of the opening operation by releasing said latching means, whereby the smaller diameter portion of the operating cylinder slides over the fixed primary portion of the composite piston structure, and means including said operating piston cylinder for trapping high-pressure gas on one side of the composite piston structure following collapse of the secondary movable piston portion.

9. The combination according to claim 8, wherein the means latching the composite piston structure comprises a toggle-linkage means, and a portion of the operating cylinder effecting release of the toggle-linkage.

* * * * *